US009892627B2

(12) United States Patent
Ferro et al.

(10) Patent No.: US 9,892,627 B2
(45) Date of Patent: Feb. 13, 2018

(54) SYSTEMS AND METHODS FOR REDUCING FALSE ALARMS USING THE GPS LOCATION OF A MOBILE DEVICE

(71) Applicant: Honeywell International Inc., Morristown, NJ (US)

(72) Inventors: Philip J. Ferro, Setauket, NY (US); James Kern, East Islip, NY (US); Michael Landi, Farmingdale, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/919,256

(22) Filed: Oct. 21, 2015

(65) Prior Publication Data

US 2017/0116847 A1 Apr. 27, 2017

(51) Int. Cl.

| | |
|---|---|
| ***G08B 29/00*** | (2006.01) |
| ***G08B 29/18*** | (2006.01) |
| ***G08B 25/00*** | (2006.01) |
| ***G08B 25/14*** | (2006.01) |

(52) U.S. Cl.

CPC ..... *G08B 29/185* (2013.01); *G08B 25/001* (2013.01); *G08B 25/14* (2013.01); *G08B 29/188* (2013.01)

(58) Field of Classification Search

CPC .... G08B 13/00; G08B 25/001; G08B 25/006; G08B 25/008; G08B 29/185; G08B 29/188; H04W 4/02

See application file for complete search history.

(56) References Cited

U.S. PATENT DOCUMENTS

| | | | | |
|---|---|---|---|---|
| 8,509,815 | B1 * | 8/2013 | Shojayi | H04W 8/04 455/456.3 |
| 2010/0271198 | A1 * | 10/2010 | Boling | B60R 25/102 340/539.1 |
| 2011/0143774 | A1 * | 6/2011 | McNamara | H04W 4/02 455/456.2 |
| 2013/0189946 | A1 | 7/2013 | Swanson | |
| 2013/0249688 | A1 | 9/2013 | Nguyen et al. | |
| 2014/0266699 | A1 * | 9/2014 | Poder | G08B 25/001 340/539.13 |

OTHER PUBLICATIONS

Extended European search report from corresponding EP patent application 16194249.5, dated Mar. 29, 2017.

* cited by examiner

*Primary Examiner* — Omeed Alizada
(74) *Attorney, Agent, or Firm* — Husch Blackwell LLP

(57) ABSTRACT

Systems and methods for reducing false alarms and providing a central station with information regarding occupants in a monitored region using a GPS location of a mobile device are provided. Some methods can include receiving a first signal indicative of a detected alarm condition in the monitored region, responsive to receiving the first signal, transmitting a second signal to the mobile device, receiving a third signal from the mobile device indicative of the GPS location of the mobile device, and based on a location of the monitored region and the third signal indicative of the GPS location of the mobile device, determining a likelihood of whether the detected alarm condition is real or false. Additionally or alternatively, some methods can include receiving the signal from the mobile device indicative of the GPS location of the mobile device at predetermined periodic time intervals and irrespective of the detected alarm condition in the monitored region.

18 Claims, 7 Drawing Sheets

SYSTEMS AND METHODS FOR REDUCING FALSE ALARMS USING THE GPS LOCATION OF A MOBILE DEVICE

FIELD

The present invention relates generally to systems and methods for reducing false alarms and for providing information to a central station. More particularly, the present invention relates to systems and methods for reducing false alarms using a GPS location of a mobile device and for providing the central station with information regarding occupants of a monitored region using the GPS location of the mobile device.

BACKGROUND

In any alarm system, reducing false alarms and determining whether occupants are in a monitored region are desired. Accordingly, systems and methods have been developed to reduce false alarms and to determine whether occupants are in the monitored region. Such known systems and methods include, but are not limited to systems and methods that include video alarm verification and audio alarm verification. However, such known systems and methods require additional equipment to be installed in the monitored region, which increases the overall cost of the system.

In view of the above, there is a continuing, ongoing need for improved systems and methods.

DETAILED DESCRIPTION

Figure 1:
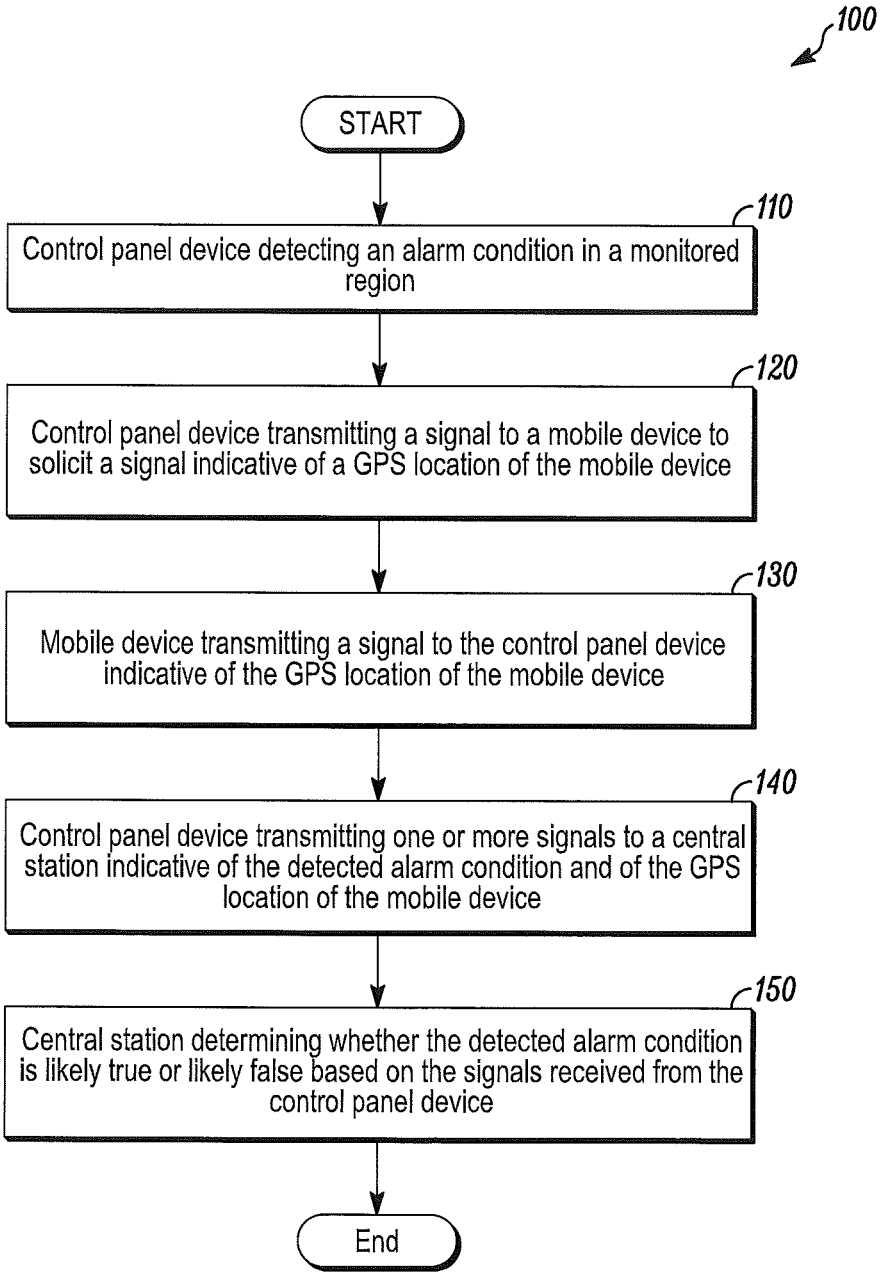
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods for reducing false alarms using a GPS location of a mobile device. Embodiments disclosed herein can also include systems and methods for providing a central station with information regarding occupants of a monitored region using the GPS location of the mobile device. For example, embodiments disclosed herein can identify the likely geolocation of one or more users, for example, a family member when the monitored region is a home or a business owner when the monitored region is an office, by identifying the GPS location of the users' mobile devices, for example, a cellular phone, personal digital assistant, and the like, and, based thereon, determine the likelihood of whether a detected alarm is real or false.

It can be advantageous for a central station operator or a third party to know whether occupants are likely in a monitored region. For example, during a detected fire alarm, operators or first responders can be advised as to any occupants in a monitored region. Similarly, during a detected motion alarm, systems and methods disclosed herein can identify the alarm as being real and of high priority when no occupants are in the monitored region.

An alarm system can include a plurality of sensor devices in the monitored region in communication with a control panel device in the monitored region and a central station located inside or outside of the monitored region in communication the control panel device. A user's mobile device can transmit a signal to the central station, either directly or via the control panel device, indicative of the GPS location of the mobile device. In some embodiments, the signal transmitted by the mobile device indicative of the GPS location of the mobile device can include a time stamp indicative of when the signal was transmitted.

In some embodiments, the mobile device can transmit the signal indicative of the GPS location of the mobile device to the central station or the control panel device responsive to receiving a signal, either from the central station or the control panel device, indicative of an alarm condition detected in the monitored region or requesting the GPS location of the mobile device. That is, in some embodiments, when the central station or the control panel device identifies the alarm condition in the monitored region, the central station or the control panel device can transmit the signal to the mobile device indicative of the alarm condition or to solicit the GPS location of the mobile device.

In some embodiments, the mobile device can transmit the signal indicative of the GPS location of the mobile device to the central station or the control panel device periodically or at predetermined time intervals. That is, in some embodiments, the mobile device can identify its location to the central station or the control panel device regardless of the alarm condition in the monitored region. In these embodiments, the central station or the control panel device can have such location identification information substantially immediately available for further processing thereof upon detection of the alarm condition.

In embodiments in which the mobile device transmits the signal indicative of the GPS location of the mobile device to the central station via the control panel device, the control panel device can identify the GPS location of the mobile device and transmit a signal indicative of both the alarm condition in the monitored region and the GPS location of the mobile device to the central station.

Responsive to receiving the signal indicative of the GPS location of the mobile device, the central station can compare the GPS location of the mobile device with a location of the monitored region and, based thereon, determine whether the alarm condition detected is likely real or likely false. In some embodiments, the central station can include a user interface device for displaying a map identifying the GPS location of the mobile device and the location of the monitored region. In these embodiments, an operator can view the map and provide user input to the central station, via the user interface device, indicative of whether the alarm condition detected is likely real or likely false.

For example, when the monitored region in alarm is in a first location, and the user's mobile device is in a second location that is in a different state than the first location, the central station or the operator thereof can determine that the likelihood that the alarm condition detected is real is high. Similarly, when the monitored region in alarm is in the first location, and the user's mobile device is in the second location that is just outside of the first location, the central station or the operator thereof can determine that the likelihood that the alarm condition detected is real is low.

In some embodiments, the mobile device can transmit a series of signals to the central station indicative of the GPS location of the mobile device, which can enable the central station or the operator thereof to identify a path of the mobile device. For example, the central station or the operator thereof can identify when the mobile device was in a respective location according to a respective time stamp of a respective one of the series of signals. In these embodiments, the central station or the operator thereof can determine that the mobile device just left the monitored region and, accordingly, that the likelihood that the alarm condition detected is real is low.

In some embodiments, the central station can transmit a signal to an emergency responder, for example, a local fire department, indicative of the locations of the mobile devices of all of the users or indicative of whether or not any of the users' mobile devices are located within the monitored region.

In accordance with disclosed embodiments, the mobile device can execute a software application running thereon. Furthermore, the user of the mobile device can consent to providing the GPS location of the mobile device to the central station or the control panel device, for example, by allowing execution of the software application running thereon.

FIG. 1 is a flow diagram of a method 100 in accordance with disclosed embodiments. As seen in FIG. 1, the method 100 can include a control panel device detecting an alarm condition in a monitored region as in 110 and, responsive thereto, transmitting a signal to a mobile device to solicit a signal indicative of a GPS location of the mobile device as in 120. Responsive to receiving the signal from the control panel device as in 120, the method 100 can include the mobile device transmitting a signal to the control panel device indicative of the GPS location of the mobile device as in 130. Then, the method 100 can include the control panel device transmitting one or more signals to a central station indicative of the alarm condition detected and of the GPS location of the mobile device as in 140. Finally, the method 100 can include the central station determining whether the alarm condition detected is likely true or likely false based on the one or more signals received from the control panel device as in 150.

Figure 2:
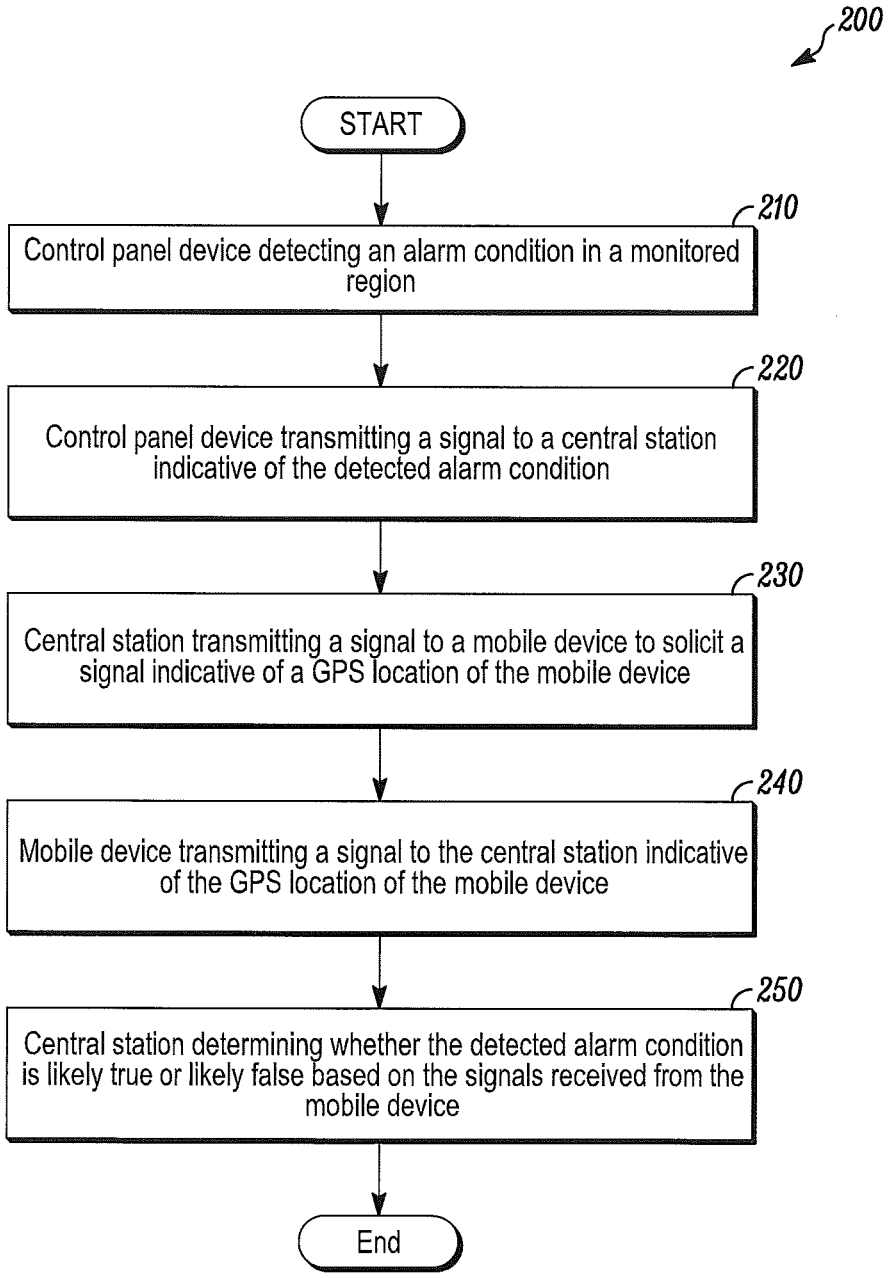
FIG. 2 is a flow diagram of a method in accordance with disclosed embodiments.

FIG. 2 is a flow diagram of a method 200 in accordance with disclosed embodiments. As seen in FIG. 2, the method 200 can include a control panel device detecting an alarm condition in a monitored region as in 210 and, responsive thereto, transmitting a signal to a central station indicative of the alarm condition detected as in 220. Responsive to receiving the signal indicative of the alarm condition detected as in 220, the method 200 can include the central station transmitting a signal to a mobile device, either directly or via the control panel device, to solicit a signal indicative of a GPS location of the mobile device as in 230. Responsive to receiving the signal soliciting the GPS location of the mobile device as in 230, the method 200 can include the mobile device transmitting a signal to the central station, either directly or via the control panel device, indicative of the GPS location of the mobile device as in 240. Then, the method 200 can include the central station determining whether the alarm condition detected is likely true or likely false based on the signal received from the mobile device as in 250.

Figure 3:
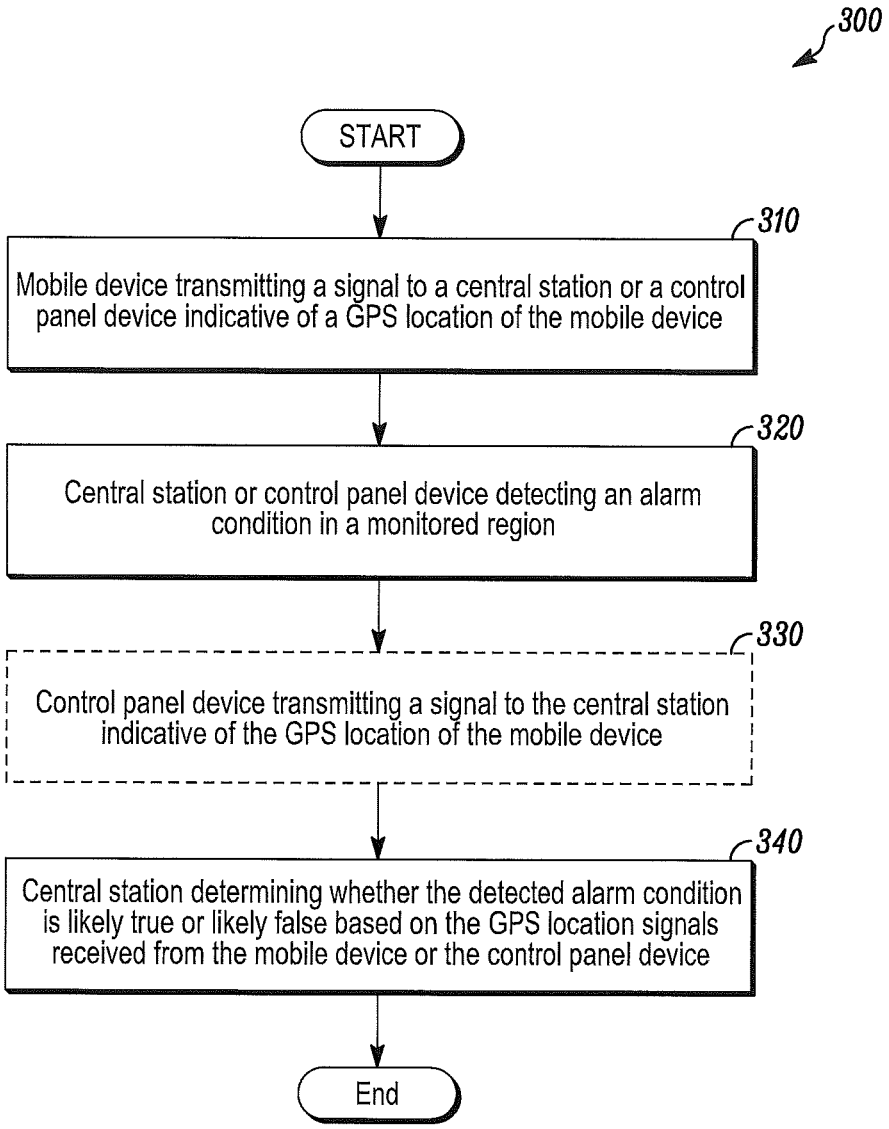
FIG. 3 is a flow diagram of a method in accordance with disclosed embodiments.

FIG. 3 is a flow diagram of a method 300 in accordance with disclosed embodiments. As seen in FIG. 3, the method 300 can include a mobile device transmitting a signal to a central station or a control panel device indicative of a GPS location of the mobile device as in 310. For example, the mobile device can transmit the signal indicative of its GPS location as in 310 periodically or at predetermined time intervals. The method 300 can also include the central station or the control panel device detecting an alarm condition in a monitored region as in 320. When the mobile device transmits its GPS location to the control panel device as in 310, the method 300 can include the control panel device transmitting a signal to the central station indicative of the GPS location of the mobile device as in 330 responsive to the central station or the control panel device detecting the alarm condition as in 320. In either embodiment, the method 300 can also include the central station determining whether the alarm condition detected is likely true or likely false based on the signal indicative of the GPS location of the mobile device and received from the mobile device or the control panel device as in 340.

Figure 4:
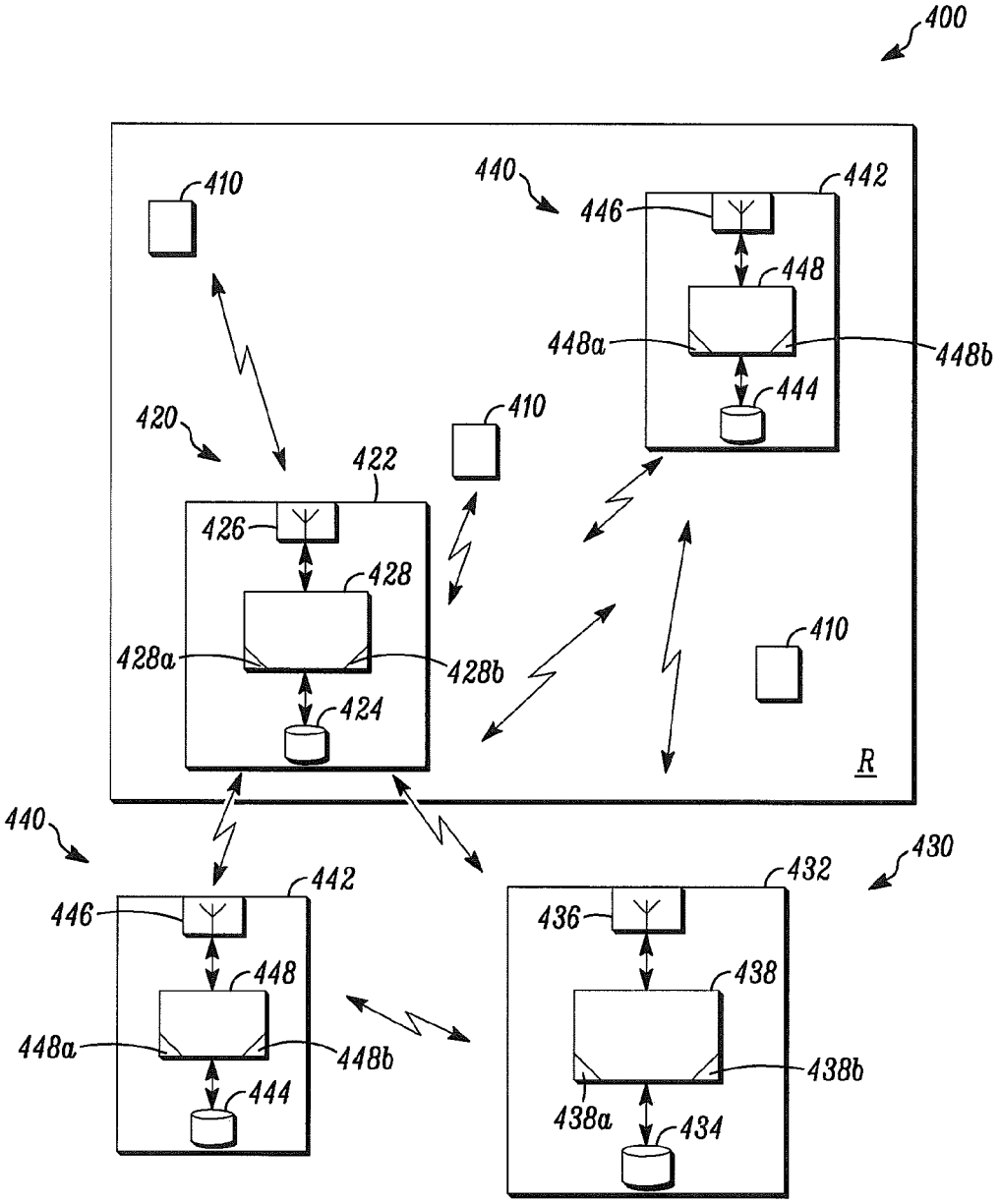
FIG. 4 is a block diagram of a system in accordance with disclosed embodiments.

FIG. 4 is a block diagram of a system 400 in accordance with disclosed embodiments. As seen in FIG. 4, the system 400 can include one or more sensor devices 410 in a monitored region R, a control panel device 420 in the monitored region R and in communication with each of the one or more sensor devices 420, and a central station device 430 in communication with the control panel device 420. Although the central station device 430 is shown outside of the monitored region R in FIG. 4, it is to be understood that, in some embodiments, the central station device 430 can be located inside of the monitored region R, and in some embodiments, the central station device 430 can be part of the control panel device 420.

The system 400 can also include one or more mobile devices 440 inside or outside of the monitored region R. Each of the one or more mobile devices 440 can be in communication directly with the control panel device 420, directly with the central station 430 device, or with the central station device 430 via the control panel device 420.

As seen in FIG. 4, the control panel device 420 can include a housing 422, a memory device 424, a transceiver 426, control circuitry 428, one or more programmable processors 428*a*, and executable control software 428*b* as would be understood by one of ordinary skill in the art. The executable control software 428*b* can be stored on a transitory or non-transitory computer readable medium, including, but not limited to local computer memory, RAM, optical storage media, magnetic storage media, flash memory, and the like. In some embodiments, the control circuitry 428, the one or more programmable processors 428*a*, and the executable control software 428*b* can execute and control some of the methods as described above and herein.

As further seen in FIG. 4, the central station device 430 can include a housing 432, a memory device 434, a transceiver 436, control circuitry 438, one or more programmable processors 438*a*, and executable control software 438*b* as would be understood by one of ordinary skill in the art. The executable control software 438*b* can be stored on a transitory or non-transitory computer readable medium, including, but not limited to local computer memory, RAM, optical storage media, magnetic storage media, flash memory, and the like. In some embodiments, the control circuitry 438, the one or more programmable processors 438*a*, and the executable control software 438*b* can execute and control some of the methods as described above and herein.

Finally, each of the one or more mobile devices 440 can include a housing 442, a memory device 444, a transceiver 446, control circuitry 448, one or more programmable processors 448*a*, and executable control software 448*b* as would be understood by one of ordinary skill in the art. The executable control software 448*b* can be stored on a transitory or non-transitory computer readable medium, including, but not limited to, local computer memory, RAM, optical storage media, magnetic storage media, flash memory, and the like. In some embodiments, the control circuitry 448, the one or more programmable processors 448*a*, and the executable control software 448*b* can execute and control some of the methods as described above and herein.

Although not shown in FIG. 4, some systems and methods disclosed herein can also include a third party device, including, but not limited to a device associated with a third party transport service, emergency responder, local fire department, and the like. In these embodiments, one or more of the control panel device, the central station, and the one or more mobile devices can communicate with the third party device for transmitting signals indicative of an alarm condition detected in the monitored region, indicative of GPS locations of the one or more mobile device, or soliciting the GPS locations of the one or more mobile devices.

Figure 5:
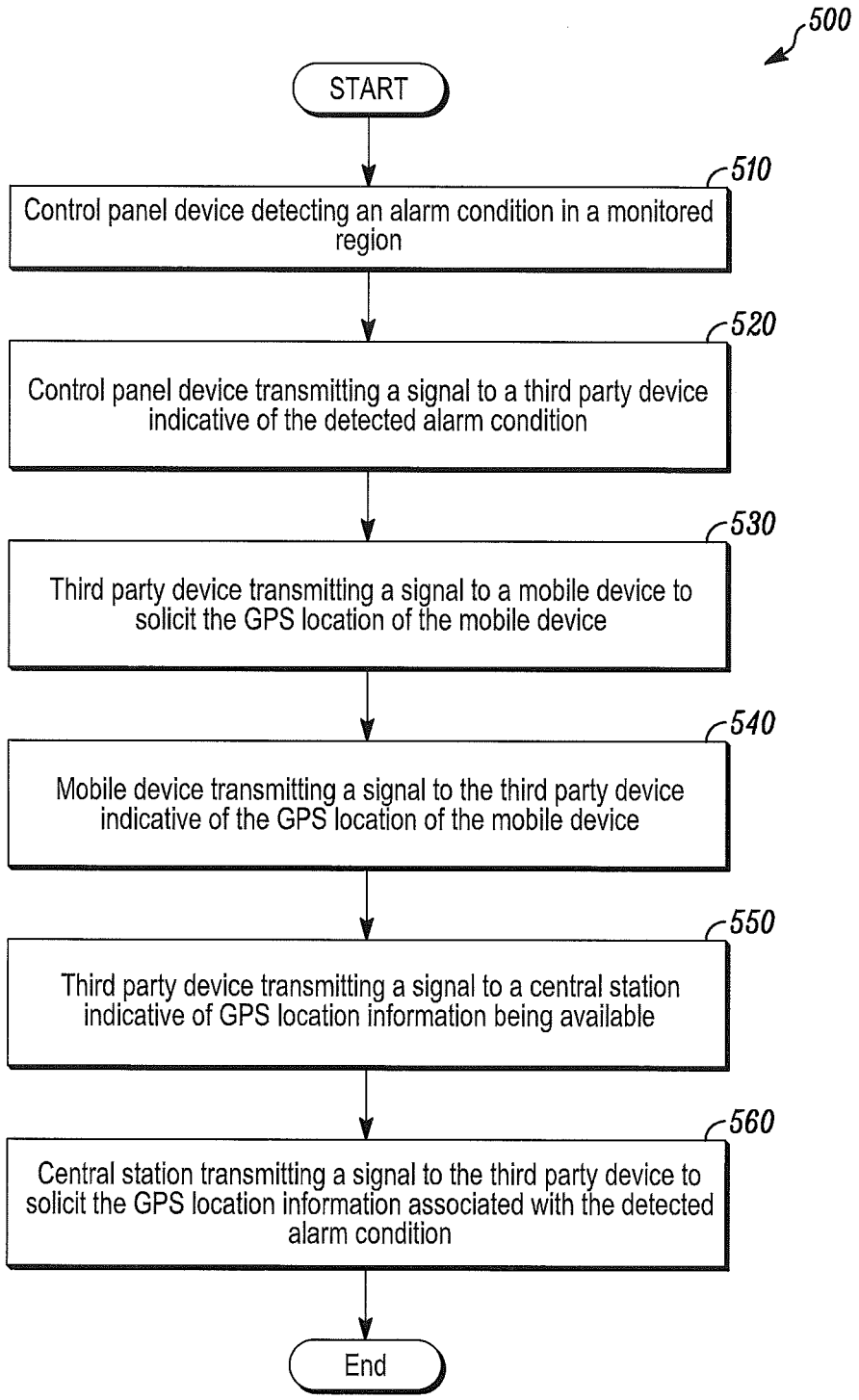
FIG. 5 is a flow diagram of a method in accordance with disclosed embodiments.

For example, FIG. 5 is a flow diagram of a method 500 in accordance with disclosed embodiments. As seen in FIG. 5, the method 500 can include a control panel device detecting an alarm condition in a monitored region as in 510 and, responsive thereto, transmitting a signal to a third party device indicative of the alarm condition detected as in 520. Responsive to receiving the signal from the control panel device as in 520, the method 500 can include the third party device transmitting a signal to a mobile device to solicit a GPS location of the mobile device as in 530. For example, the third party device can transmit the signal as in 530 to one or more mobile devices registered with the third party device or the control panel device or associated with the monitored region. Responsive to receiving the signal from the third party device as in 530, the method 500 can include the mobile device transmitting a signal to the third party device indicative of the GPS location of the mobile device as in 540, and the third party device transmitting a signal to a central station indicative of GPS location information being available as in 550. Responsive to the central station receiving the signal as in 550, the method 500 can include the central station transmitting a signal to the third party device to solicit the GPS location information associated with the alarm condition detected as in 560. For example, the third party device or the central station can identify the mobile device as being associated with the monitored region in alarm. In these embodiments, the third party device can notify the central station when the GPS location information is available, and the central station can request such information on demand.

Figure 6:
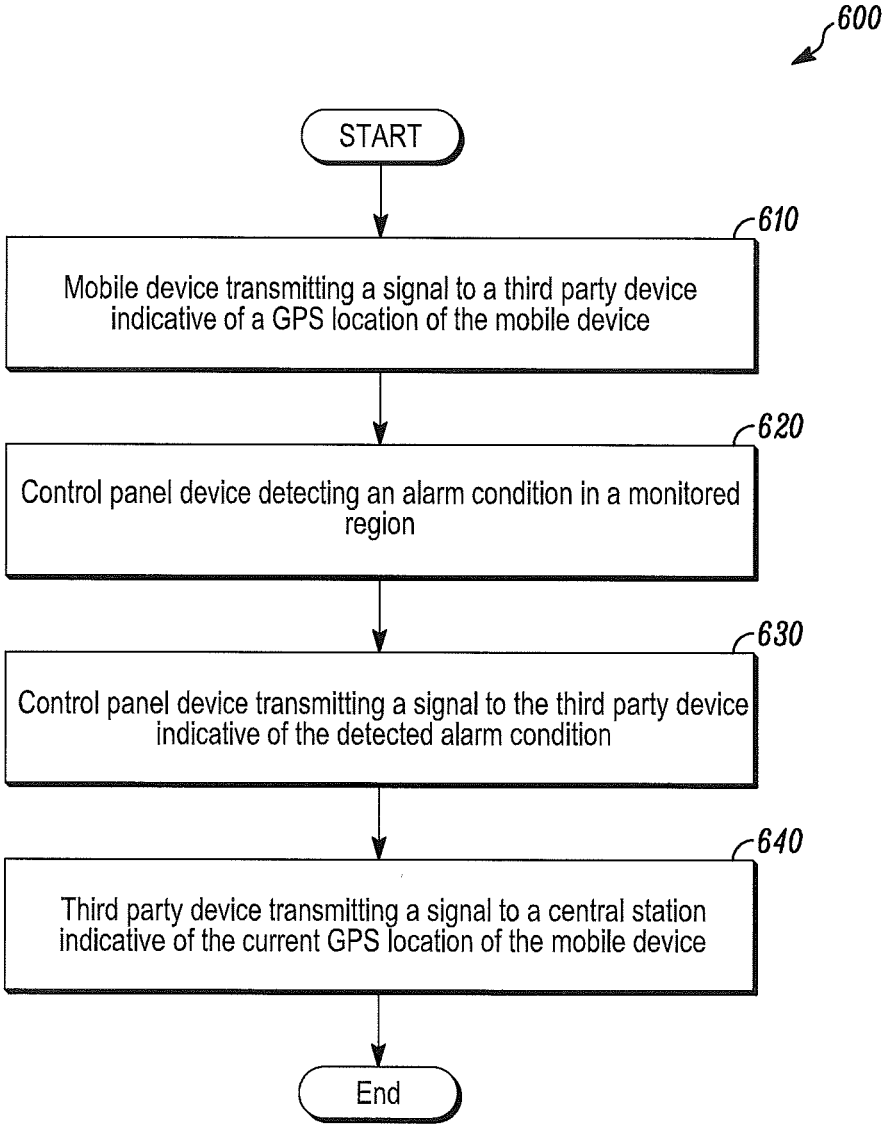
FIG. 6 is a flow diagram of a method in accordance with disclosed embodiments.

FIG. 6 is a flow diagram of a method 600 in accordance with disclosed embodiments. As seen in FIG. 6, the method 600 can include a mobile device transmitting a signal to a third party device indicative of a GPS location of the mobile device as in 610. For example, one or more mobile devices registered with the third party device can transmit signals indicative of their GPS locations as in 610 periodically or at predetermined time intervals. The method 600 can also include a control panel device detecting an alarm condition in a monitored region as in 620 and, responsive thereto, the control panel device transmitting a signal to the third party device indicative of the alarm condition detected as in 630. Responsive to the third party device receiving the signal as in 630, the method 600 can include the third party device transmitting a signal to a central station indicative of a current GPS location of the mobile device as in 640. For example, the third party device can identify the current GPS location of the mobile device as the GPS location of the mobile device identified in a most recently received signal from the mobile device.

Figure 7:
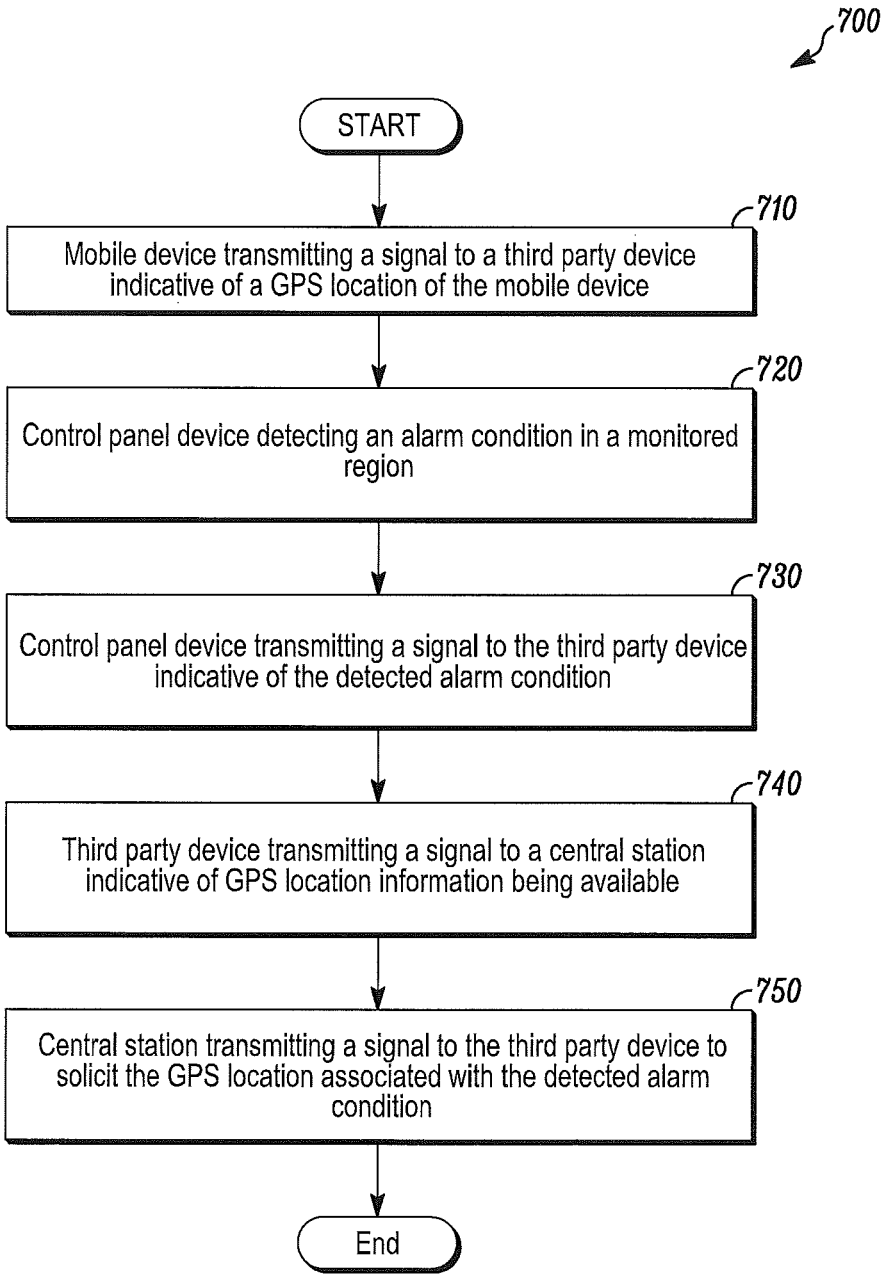
FIG. 7 is a flow diagram of a method in accordance with disclosed embodiments.

FIG. 7 is a flow diagram of a method 700 in accordance with disclosed embodiments. As seen in FIG. 7, the method 700 can include a mobile device transmitting a signal to a third party device indicative of a GPS location of the mobile device as in 710. For example, one or more mobile devices registered with the third party device can transmit signals indicative of their GPS locations as in 710 periodically or at predetermined time intervals. The method 700 can also include a control panel device detecting an alarm condition in a monitored region as in 720 and, responsive thereto, the control panel device transmitting a signal to the third party device indicative of the alarm condition detected as in 730. Responsive to the third party device receiving the signal as in 730, the method 700 can include the third party device transmitting a signal to a central station indicative of GPS location information being available as in 740. Responsive to the central station receiving the signal as in 740, the method 700 can include the central station transmitting a signal to the third party device to solicit the GPS location information associated with the alarm condition detected as in 750. For example, the third party device or the central station can identify the mobile device as being associated with the monitored region in alarm. In these embodiments, the third party device can notify the central station when the GPS location information is available, and the central station can request such information on demand.

Although the methods 100, 200, 300, 400, 500, 600, and 700 are shown as separate flow diagrams, it is to be understood that any or all of these methods can be combined as would be understood by one of ordinary skill in the art. For example, a mobile device can communicate with a control panel device as in the method 100 or the method 300, with a central station as in the method 200 or the method 300, and with a third party device as in the method 500, the method 600, or the method 700 substantially simultaneously and without limitation. Similarly, a central station can communicate with a control panel device as in the method 100, the method 200, or the method 300, and a central station and a control panel device can communicate with a third party device as in the method 500, the method 600, or the method 700 substantially simultaneously and without limitation.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

a control panel device detecting an alarm condition in a monitored region;

a third party device receiving, from the control panel device, a first signal indicative of the alarm condition;

the third party device, responsive to receiving the first signal, transmitting a second signal to a mobile device;

the third party device receiving a third signal from the mobile device indicative of a location of the mobile device;

the third party device transmitting a fourth signal to a central station device indicative of the location of the mobile device being available;

the third party device receiving a fifth signal requesting the location of the mobile device from the central station device;

the third party device, responsive to receiving the fifth signal, transmitting a sixth signal indicative of the alarm condition and the location of the mobile device to the central station device; and the central station device, based on a location of the monitored region and the location of the mobile device, determining a likelihood of whether the alarm condition is real or false.

2. The method of claim 1 wherein the control panel device detecting the alarm condition includes receiving an alert signal from a sensor device in the monitored region.

3. The method of claim 1 wherein the third party device transmitting the second signal includes the third party device transmitting the second signal directly to the mobile device or transmitting the second signal to the mobile device via the control panel device.

4. The method of claim 1 wherein the third party device receiving the third signal includes the third party device receiving the third signal directly from the mobile device or via the control panel device.

5. The method of claim 1 wherein the third signal includes a time stamp indicative of a time when the third signal is transmitted.

6. The method of claim 1 wherein the central station device determining the likelihood of whether the alarm condition is real or false includes comparing the location of the monitored region and the location of the mobile device.

7. The method of claim 6 further comprising the central station device determining that the alarm condition is likely real when the location of the mobile device is greater than a predetermined distance away from the location of the monitored region.

8. The method of claim 1 wherein the central station device determining the likelihood of whether the alarm condition is real or false includes displaying, on a user interface device of the central station device, a graphical or textual representation of the location of the monitored region and the location of the mobile device and receiving, via the user interface device, user input indicative of the likelihood of whether the alarm condition is real or false.

9. A method comprising:

a third party device receiving a first signal from a mobile device indicative of a location of the mobile device;

a control panel device detecting an alarm condition in a monitored region;

the third party device receiving, from the control panel device, a second signal indicative of the alarm condition;

the third party device transmitting a third signal to a central station device indicative of the location of the mobile device being available;

the third party device receiving a fourth signal requesting the location of the mobile device from the central station device;

the third party device, responsive to receiving the fourth signal, transmitting a fifth signal indicative of the alarm condition and the location of the mobile device to the central station device; and the central station device, based on a location of the monitored region and the location of the mobile device, determining a likelihood of whether the alarm condition is real or false.

10. The method of claim 9 wherein the third party device receiving the first signal from the mobile device includes the third party device receiving the first signal from the mobile device at predetermined periodic time intervals.

11. The method of claim 9 wherein the first signal includes a time stamp indicative of a time when the first signal is transmitted.

12. The method of claim 9 wherein the third party device receiving the first signal includes the third party device receiving the first signal directly from the mobile device or via the control panel device.

13. The method of claim 9 wherein the control panel device detecting the alarm condition includes receiving an alert signal from a sensor device in the monitored region.

14. The method of claim 9 wherein the central station device determining the likelihood of whether the alarm condition is real or false includes the central station device comparing the location of the monitored region and the location of the mobile device.

15. The method of claim 14 further comprising the central station device determining that the alarm condition is likely real when the location of the mobile device is greater than a predetermined distance away from the location of the monitored region.

16. The method of claim 9 wherein the central station device determining the likelihood of whether the alarm condition is real or false includes displaying, on a user interface device of the central station device, a graphical or textual representation of the location of the monitored region and the location of the mobile device and receiving, via the user interface device, user input indicative of the likelihood of whether the alarm condition is real or false.

17. A system comprising:

a control panel device in a region;

a third party device;

a central station device monitoring the region; and at least one mobile device, wherein, upon detecting an alarm condition in the region, the control panel device transmits a first signal indicative of the alarm condition in the region to the third party device, wherein, upon receiving the first signal indicative of the alarm condition in the region, the third party device identifies a location of the at least one mobile device, wherein the third party device transmits a second signal to the central station device indicative of the location of the at least one mobile device being available, wherein the third party device receives a third signal requesting the location of the at least one mobile device from the central station device, wherein the third party device, responsive to receiving the third signal, transmits a fourth signal indicative of the alarm condition and the location of the at least one mobile device to the central station device, and wherein, based on a location of the region and the location of the at least one mobile device, the central station device determines a likelihood of whether the alarm condition is real or false.

18. The system of claim 17 wherein the third party device receives a fifth signal from the at least one mobile device directly or via the control panel device in the region, and wherein the fifth signal is indicative of the location of the at least one mobile device.

* * * * *